US006106240A

United States Patent [19]

Fischer et al.

[11] Patent Number: 6,106,240

[45] Date of Patent: Aug. 22, 2000

[54] GEROTOR PUMP

[75] Inventors: John Gardner Fischer, Goodrich; Giulio Angel Ricci-Ottati, Burton, both of Mich.

[73] Assignee: General Motors Corporation, Detroit, Mich.

[21] Appl. No.: 09/067,155

[22] Filed: Apr. 27, 1998

[51] Int. Cl.[7] ..... F04B 23/14

[52] U.S. Cl. ..... 417/203; 417/423.6

[58] Field of Search ..... 418/171, 166; 417/203, 423.6

[56] References Cited

U.S. PATENT DOCUMENTS

| | | | |
|---|---|---|---|
| 2,544,144 | 3/1951 | Ellis | 103/126 |
| 3,204,564 | 9/1965 | Eltze | 103/126 |
| 3,680,989 | 8/1972 | Brundage | 418/71 |
| 3,834,842 | 9/1974 | Dorff et al. | 418/75 |
| 4,199,305 | 4/1980 | Pareja | 417/440 |
| 4,231,726 | 11/1980 | Cobb et al. | 418/75 |
| 4,897,025 | 1/1990 | Negishi | 418/171 |
| 4,978,282 | 12/1990 | Fu et al. | 417/410 |
| 5,046,933 | 9/1991 | Haga et al. | 418/78 |
| 5,145,348 | 9/1992 | Zumbusch | 418/171 |
| 5,393,203 | 2/1995 | Hantle | 417/203 |

*Primary Examiner*—Henry C. Yuen
*Assistant Examiner*—Mahmoud M Gimie
*Attorney, Agent, or Firm*—Vincent A. Cichosz

[57] ABSTRACT

A gerotor pump including a ring gear and a pinion gear supported on a pump housing for rotation about parallel, laterally separated centerlines. A plurality of pump chambers defined by the teeth of the ring and pinion gears expand in an inlet half of a crescent-shaped cavity between the ring and pinion gears and collapse in a discharge half. An inlet port in a first side wall of the pump housing faces the inlet half of the crescent-shaped cavity. A primary discharge port in an opposite second side wall of the pump housing faces the discharge half of the crescent-shaped cavity and is timed relative to the inlet port for pumping low bulk modulus fluid. A shallow groove in the first end wall of the housing defines a secondary discharge port timed relative to the inlet port for pumping high bulk modulus fluid. In the timing interval between the secondary and the primary discharge ports, i.e. when the pump chambers overlap only the secondary discharge port, the shallow groove defines a restricted passage which releases high bulk modulus fluid to prevent pressure spikes while maintaining sufficient back pressure to collapse entrained vapor bubbles in low bulk modulus fluid.

7 Claims, 4 Drawing Sheets

GEROTOR PUMP

TECHNICAL FIELD

This invention relates to a positive displacement fluid pump commonly referred to as a gerotor pump.

BACKGROUND OF THE INVENTION

In a positive displacement fluid pump commonly referred to as a gerotor pump, a ring gear and a pinion gear inside of the ring gear are supported on a pump housing for rotation about parallel, laterally separated centerlines. A plurality of pump chambers defined by the teeth of the ring and pinion gears expand in an inlet half of a crescent-shaped cavity between the ring and pinion gears and collapse in a discharge half of the crescent-shaped cavity. An inlet port in a first side wall of the pump housing faces the inlet half of the crescent-shaped cavity. A discharge port in an opposite second side wall of the pump housing faces the discharge half of the crescent-shaped cavity. The inlet and the discharge ports are separated angularly or "timed" to prevent the pump chambers from simultaneously overlapping both the inlet port and the discharge port. The bulk modulus of the fluid being pumped and the timing between the inlet and the discharge ports affect the performance of gerotor pumps. For high bulk modulus fluids, i.e. fluids having insubstantial volumes of entrained vapor bubbles, minimum port timing is desirable because mechanical compression of the fluid trapped between the inlet and the discharge ports may create noise inducing pressure spikes. For lower bulk modulus fluids, i.e. fluids having significant volumes of entrained vapor bubbles, increased port timing promotes mechanical compression of the trapped fluid to collapse the vapor bubbles in the pump chamber instead of in the discharge port where such collapse may create noise inducing pressure pulses. In an application such as a motor vehicle fuel pump where the bulk modulus of the fluid being pumped, e.g. gasoline, may be low in hot weather and high in cold weather, timing the ports for one of high and low bulk modulus fluid may negatively impact the performance of the fuel pump when the other is being pumped. A gerotor pump according to this invention is an improvement over prior gerotor pumps having port timing for only one of high and low bulk modulus fluid.

SUMMARY OF THE INVENTION

This invention is a new and improved positive displacement gerotor fluid pump including a ring gear and a pinion gear inside of the ring gear supported on a pump housing for rotation about parallel, laterally separated centerlines. A plurality of pump chambers defined by the teeth of the ring and the pinion gears expand in an inlet half of a crescent-shaped cavity between the ring and the pinion gears and collapse in a discharge half of the crescent-shaped cavity. An inlet port in a first side wall of the pump housing faces the inlet half of the crescent-shaped cavity. A primary discharge port in an opposite second side wall of the pump housing faces the discharge half of the crescent-shaped cavity and is timed relative to the inlet port for pumping low bulk modulus fluid. A shallow groove in the first end wall of the housing defines a secondary discharge port on the opposite side of the crescent-shaped cavity from the primary discharge port timed relative to the inlet port for pumping high bulk modulus fluid. In the timing interval between the secondary and the primary discharge ports, i.e. when the pump chambers overlap only the secondary discharge port, the shallow groove defines a restricted passage which releases high bulk modulus fluid to prevent noise inducing pressure spikes while maintaining sufficient back pressure in the pump chambers to collapse entrained vapor bubbles in low bulk modulus fluid.

DESCRIPTION OF THE PREFERRED EMBODIMENT

Figure 1:
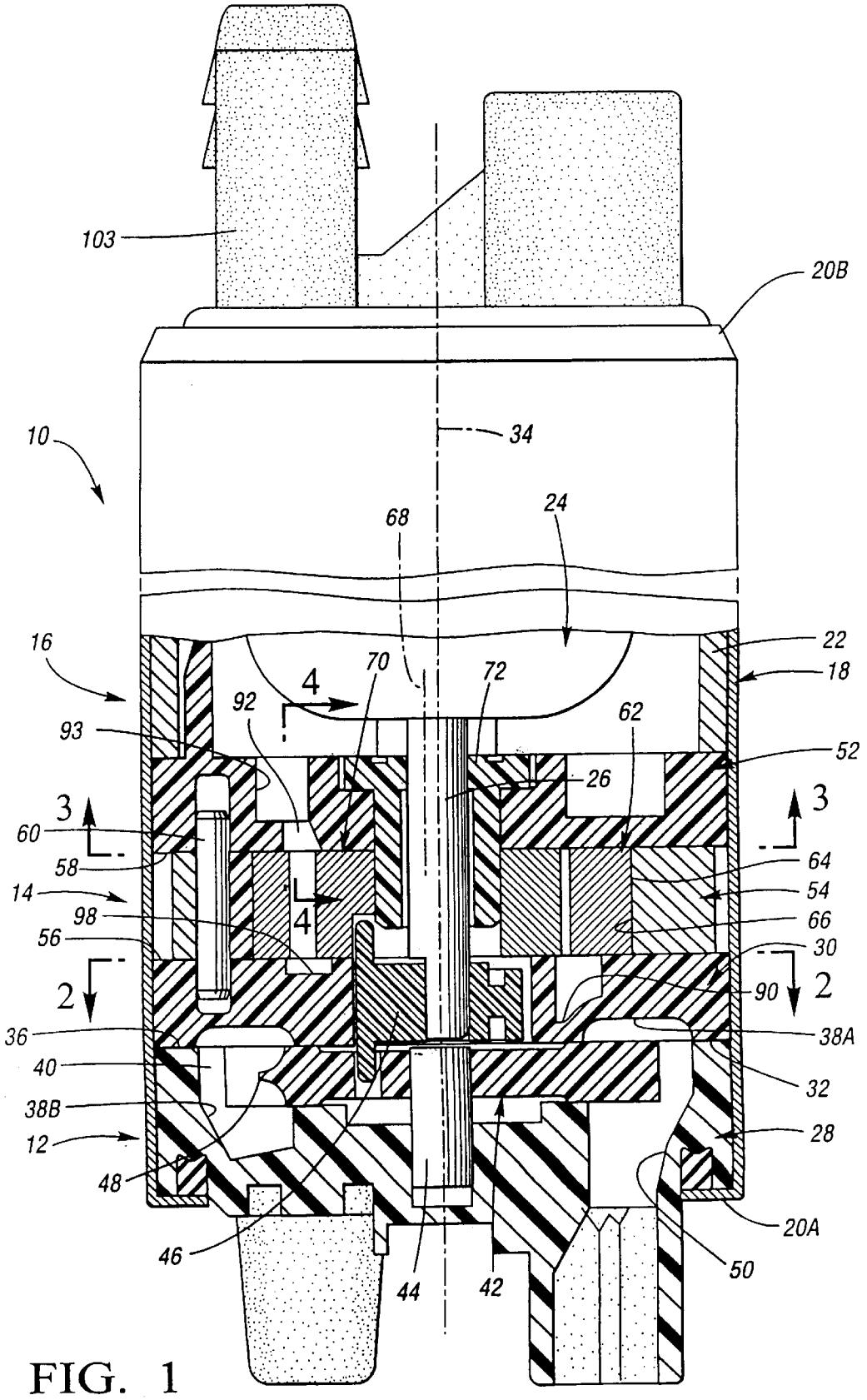
FIG. 1 is a fragmentary, partially broken-away view of an electric fuel pump for a motor vehicle including a gerotor pump according to this invention.
Figures 6A, 6B:
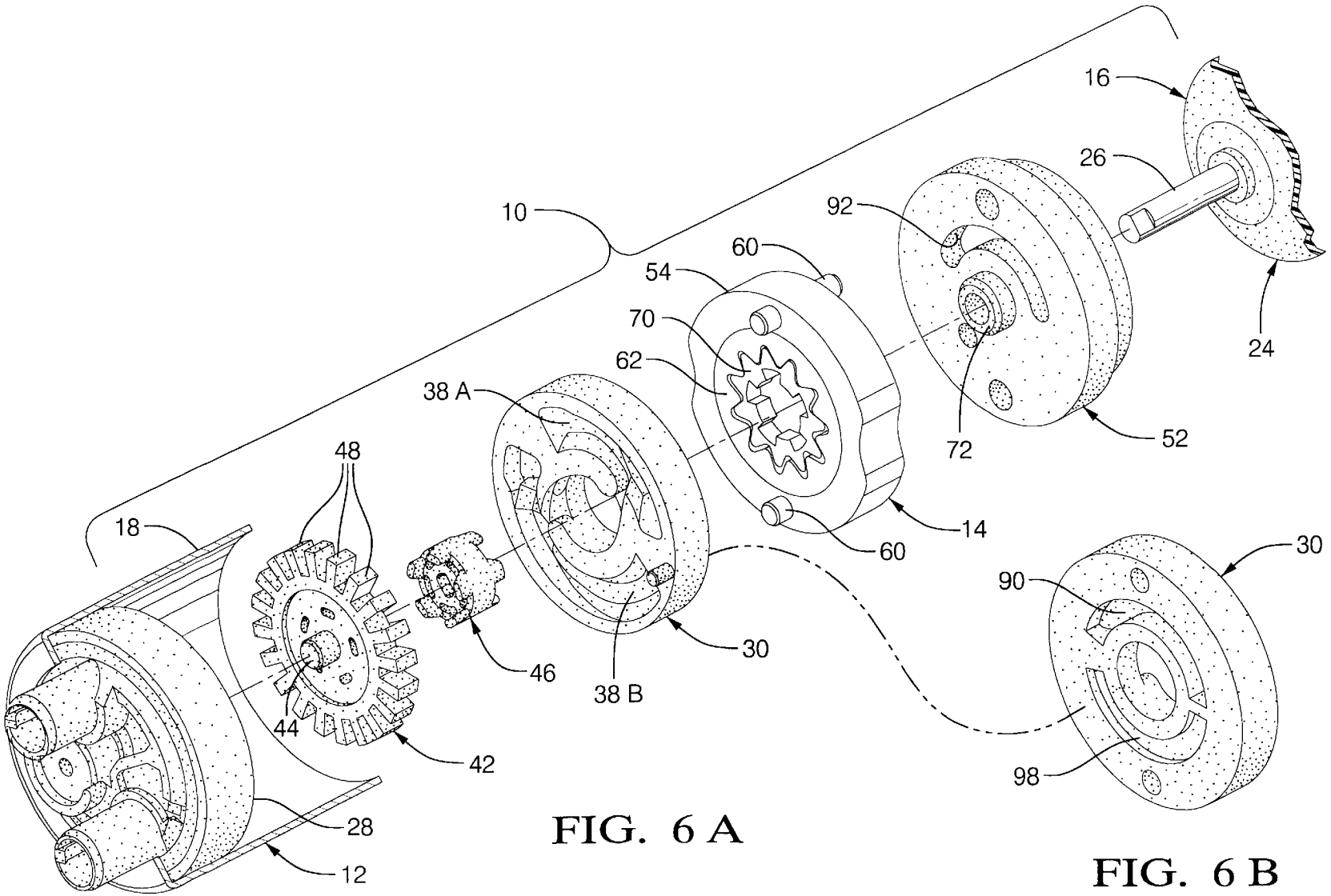
FIG. 6 is a fragmentary, exploded, perspective view of the gerotor pump according to this invention .

An electric fuel pump 10 for a motor vehicle, not shown, includes a low pressure pump 12, a high pressure gerotor pump 14 according to this invention, and an electric motor 16 all housed within a tubular shell 18 and captured between a pair of turned-in lips 20A,20B at opposite ends of the shell as shown in FIGS. 1 and 6. The electric motor 16 includes a flux ring 22, an armature core 24 on an armature shaft 26, and a plurality of permanent magnets, not shown, on the flux ring facing the armature core. The electric fuel pump 10 is submerged in motor vehicle fuel, e.g. gasoline, in a fuel tank, not shown, of the motor vehicle or in a reservoir, not shown, in the fuel tank.

The low pressure pump 12 includes a first plastic end body 28 seated against the turned-in lip 20A on the shell 18 and closing the corresponding end thereof and a disc-shaped plastic partition 30 having an outboard side 32 perpendicular to a longitudinal centerline 34 of the fuel pump seated against an inboard side 36 of the first end body 28. A pair of annular grooves 38A,38B in the outboard side 32 of the partition and in the inboard side 36 of the first end body face each other and cooperate in defining an annular pump channel 40 of the low pressure pump between the partition and the first end body.

A disc-shaped impeller 42 of the low pressure pump 12 between the partition and the first end body is supported on a stub shaft 44 on the first end body 28 for rotation about the longitudinal centerline 34 of the fuel pump. The armature shaft 26 of the electric motor 16 is coupled to a barrel-shaped driver 46 supported on the partition 30 for rotation about the longitudinal centerline 34 of the fuel pump. The driver 46 is coupled to the impeller 42 to rotate the latter about the longitudinal centerline 34 of the fuel pump concurrent with rotation of the armature shaft.

A plurality of vanes 48 on the periphery of the impeller 42 are disposed in the annular pump channel 40 and cooperate therewith in constituting the low pressure pump 12 a conventional regenerative turbine pump. The annular pump channel 40 is interrupted by a seal, not shown, which closely surrounds the periphery of the impeller 42 and separates an inlet port 50 of the low pressure pump in the first end body 28 from a discharge port of the low pressure pump, not shown, in the partition 30. The inlet port 50 communicates with the aforesaid fuel tank or reservoir. The discharge port of the low pressure pump communicates through the partition 30 with the gerotor pump 14 according to this invention between the partition and a second plastic end body 52 which separates the gerotor pump from the interior of shell 18 around the electric motor 16.

The gerotor pump 14 includes a metal bearing ring 54 between a flat inboard side 56 of the partition 30 opposite the outboard side 32 thereof and a flat outboard side 58 of the second plastic end body 52. Relative rotation between the ring 54, the partition 30 and the second end body 52 is prevented by a plurality of dowels 60. A coupling, not shown, between the second end body 52 and the flux ring 22 prevents unitary rotation of the second end body, the ring, and the partition inside of the shell.

The gerotor pump 14 further includes a ring gear 62 having a cylindrical outside surface 64 cooperating with a cylindrical inside surface 66 of the bearing ring 54 in supporting the ring gear 62 on the shell 18 of the fuel pump for rotation about a longitudinal centerline 68 parallel to and laterally separated from the longitudinal centerline 34 of the fuel pump. A pinion gear 70 of the gerotor pump is disposed inside of the ring gear 62 and coupled to the armature shaft 26 through a second driver 72 for rotation as a unit with the armature shaft about the longitudinal centerline 34 of the fuel pump.

Figure 5:
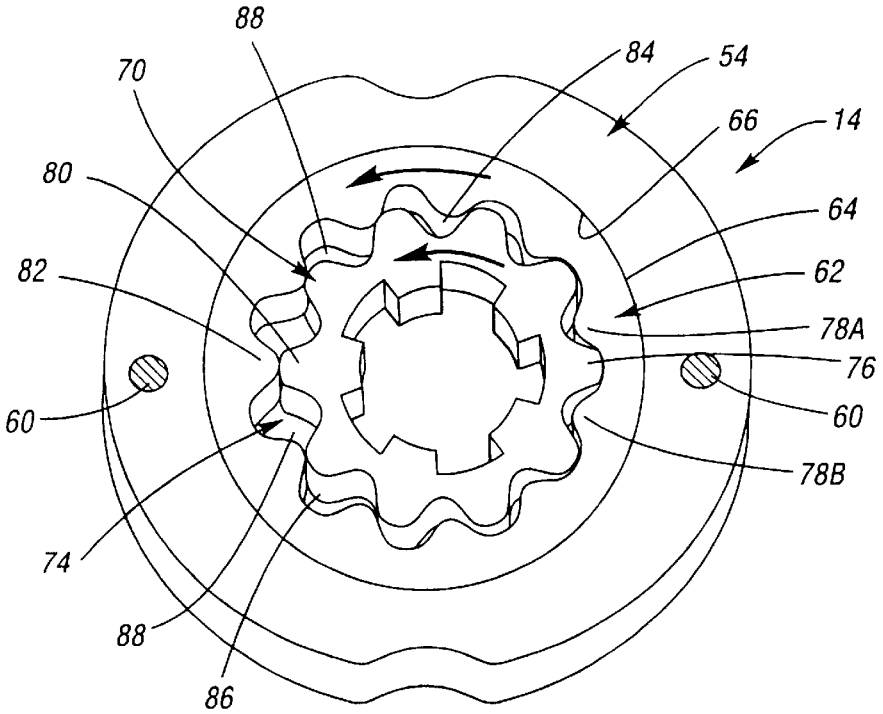
FIG. 5 is a perspective view of a ring gear and a pinion gear of the gerotor pump according to this invention.

The lateral separation between the longitudinal centerlines 34,68 defines a crescent-shaped cavity 74, FIG. 5, between the ring gear 62 and the pinion gear 70 closed on opposite sides by the flat inboard side 56 and the flat outboard side 58 of the partition 30 and of the second end body 52, respectively. The wedge-shaped ends of the crescent shaped cavity 74 are separated from each other by a tooth 76 on the pinion gear in full mesh with a pair of teeth 78A,78B on the ring gear. With counterclockwise rotation of the ring gear 62 and the pinion gear 70 as indicated by the directional arrows in FIG. 5, a tooth 80 on the pinion gear cooperates with a tooth 82 on the ring gear in dividing the crescent-shaped cavity into an inlet half 84 and a discharge half 86. The gear teeth on the pinion gear and the ring gear cooperate in defining a plurality of pump chambers 88 of the gerotor pump which expand in the inlet half 84 of the crescent-shaped cavity and which collapse in the discharge half 86 of the crescent-shaped cavity.

Figure 2:
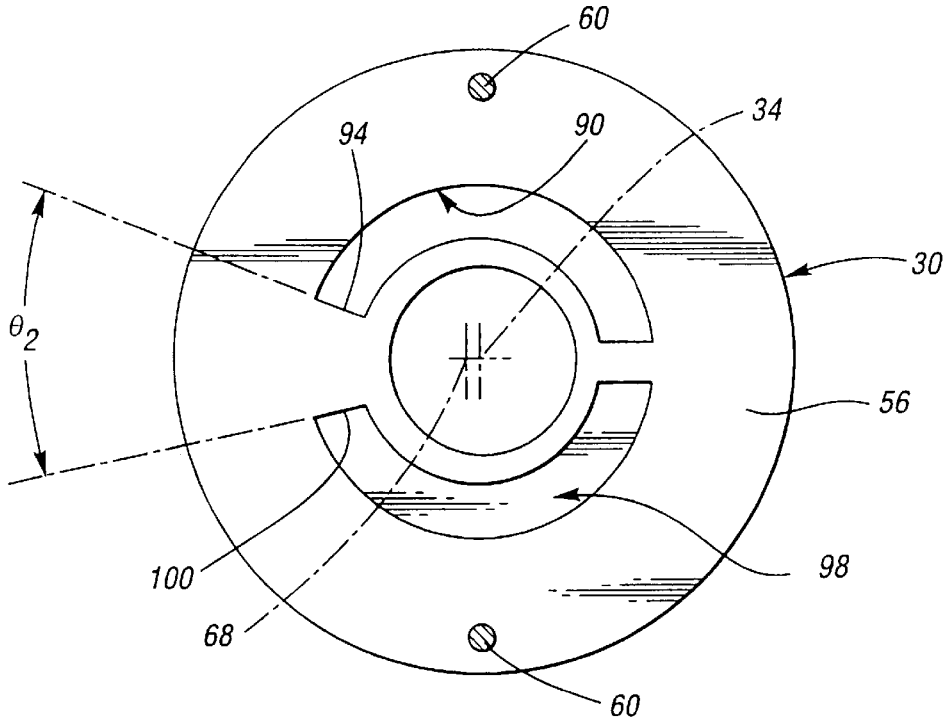
FIG. 2 is a sectional view taken generally along the plane indicated by lines 2—2 in FIG. 1.
Figure 3:
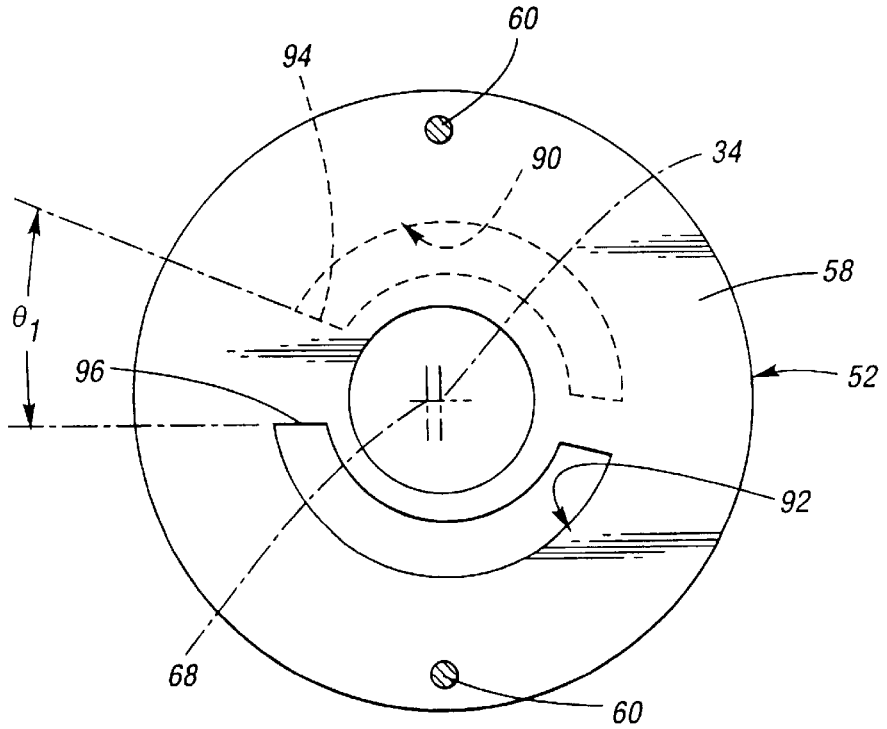
FIG. 3 is a sectional view taken generally along the plane indicated by lines 3—3 in FIG. 1.
Figure 4:
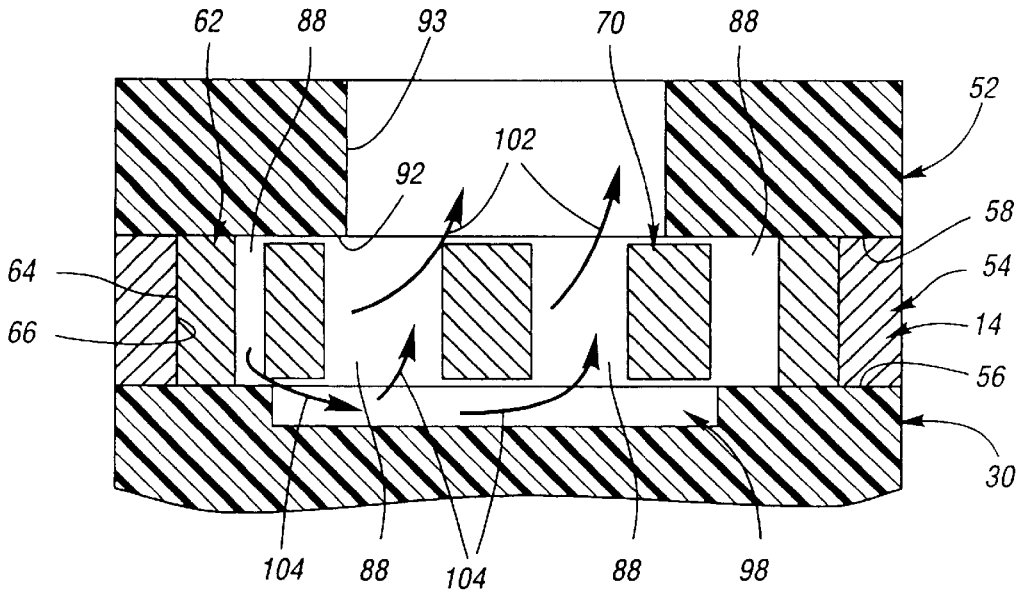
FIG. 4 is a schematic sectional view taken generally in the direction indicated by lines 4—4 in FIG. 1.

As seen best in FIGS. 2–4, an inlet port 90 of the gerotor pump, illustrated in solid lines in FIG. 2 and in broken lines in FIG. 3, is defined by a groove in the inboard side 56 of the partition 30 and faces the inlet half 84 of the crescent-shaped cavity 74. The inlet port 90 communicates with the aforesaid discharge port, not shown, of the low pressure pump 12 through the partition 30. A primary discharge port 92 of the gerotor pump is formed by a groove in the outboard side 58 of the second plastic end body 52 facing the discharge half 86 of the crescent-shaped cavity 74. The primary discharge port communicates with the interior of the shell 18 around the electric motor 16 through a passage 93 in the second end body. The timing between the inlet port 90 and the primary discharge port 92 is characterized by an angle $\theta_1$, FIG. 3, between a downstream end 94 of the inlet port and an upstream end 96 of the primary discharge port.

A secondary discharge port 98 of the gerotor pump is defined by a groove in the inboard side 56 of the partition 30 about about 0.2 mm deep relative to the plane of the inboard side of the partition. The secondary discharge port faces the discharge half 86 of the crescent-shaped cavity 74. The secondary discharge port 98 faces and therefore "shadows" the primary discharge port 92 on the opposite side of the crescent-shaped cavity from the primary discharge port and communicates with the primary discharge port across the discharge half of the crescent shaped cavity 74. The timing between the inlet port 90 and the secondary discharge port 98 is characterized by an angle $\theta_2$, FIG. 2, between the downstream end 94 of the inlet port and an upstream end 100 of the secondary discharge port. The angle $\theta_1$ exceeds the angle $\theta_2$ so that the timing between the inlet port 90 and the primary discharge port 92 is more suitable for pumping low bulk modulus fluids than the timing between the inlet port and the secondary discharge port 98 while the timing between the inlet port and the secondary discharge port is more suitable for pumping high bulk modulus fluids than the timing between the inlet port and the primary discharge port.

The electric fuel pump 10 operates as now described. When the electric motor 16 is on, the armature shaft 26 concurrently spins the impeller 42 and rotates the ring gear 62 and the pinion gear 70. The low pressure pump 12 transfers fuel from the fuel tank or reservoir of the motor vehicle to the inlet port 90 of the gerotor pump 14 at a moderate charging pressure to suppress cavitation at the expanding pump chambers 88 of the gerotor pump in the inlet half 84 of the crescent-shaped cavity 74. The fuel is expelled from the collapsing pump chambers in the discharge half 86 of the crescent-shaped cavity into the primary discharge port 92 and the passage 93 as indicated by a flow direction arrow 102, FIG. 4, against a back pressure in the interior of the shell 18 around the electric motor. Fuel exits the electric fuel pump through a discharge fitting 103 of the fuel pump.

As each of the pump chambers 88 traverses the crescent-shaped cavity 74 from the inlet half thereof to the discharge half, the fuel in the pump chambers is momentarily completely trapped to assure separation between the inlet port 90 and the primary and the secondary discharge ports 92,98. Because the timing angle $\theta_1$ exceeds the timing angle $\theta_2$, the pump chambers 88 achieve overlap with the secondary discharge port 98 ahead of overlap with the primary discharge port 92 and sustain such exclusive overlap in an angular interval $(\theta_1-\theta_2)$. In the angular interval $(\theta_1-\theta_2)$, the pump chambers 88 communicate with the primary discharge port 92 through a restricted passage defined by the secondary discharge port 98 and represented by flow direction arrows 104, FIG. 4. Beyond the angular interval $(\theta_1-\theta_2)$, the pump chambers are exposed directly to the primary discharge port for fuel flow as indicated by the flow direction arrows 102.

For pumping fuel having a high bulk modulus, i.e. having only an insubstantial volume of entrained vapor bubbles, the timing angle $\theta_2$ is calculated to minimize the duration during which fuel is completely trapped in the pump chambers 88. That is, in the angular interval $(\theta_1-\theta_2)$, the flow path through the secondary discharge port 98 to the primary discharge port 92 affords pressure relief for the pump chambers which prevents noise inducing pressure spikes in the pump chambers attributable to mechanical compression of the liquid fuel therein.

For pumping fuel having a relatively lower bulk modulus, i.e. having a substantial volume of entrained vapor bubbles, the flow restriction afforded by the shallow secondary discharge port 98 maintains the pump chambers effectively closed throughout the angular interval $(\theta_1-\theta_2)$. The flow restriction afforded by the secondary discharge port 98 is calculated to maintain a back pressure in the pump chambers 88 which exceeds the vapor pressure of the entrained vapor bubbles so that mechanical compression of the fuel in the pump chambers in the angular interval $(\theta_1-\theta_2)$ collapses the vapor bubbles before the pump chambers attain overlap with the primary discharge port 92. By inducing collapse of the vapor bubbles in the pump chambers isolated from the primary discharge port except through the secondary discharge port, noise attributable to pressure pulses of vapor bubbles collapsing in the primary discharge port is suppressed.

It is desirable to minimize manufacturing tolerances which affect the timing angle $\theta_2$ for pumping fluids having a high bulk modulus because wide tolerances unnecessarily increase the timing angle and the susceptibility of the gerotor pump to noise attributable to mechanical compression of trapped fluid. Accordingly, it is an important feature of this invention that the secondary discharge port 98 and the inlet port 90 are each on the partition 30 because maintaining close manufacturing tolerances corresponding to minimization of the timing angle $\theta_2$ is accomplished substantially more economically when the inlet port and the secondary discharge port are on one structural element than when they are defined on separate structural elements assembled with fasteners or like.

Having thus described the invention, what is claimed is:

1. A gerotor pump comprising:

an outer ring gear rotatable on a housing of said gerotor pump about a first centerline, an inner pinion gear inside of said ring gear rotatable on said housing of said gerotor pump about a second centerline parallel to and separated from said first centerline so that a crescent-shaped cavity is defined between said ring gear and said pinion gear, a pair of planar sides of said housing closing opposite sides of said crescent-shaped cavity, a plurality of gear teeth on said ring gear and on said pinion gear cooperating in dividing said crescent-shaped cavity into an inlet half and a discharge half and into a plurality of pump chambers traversing said crescent-shaped cavity from said inlet half to said discharge half, an inlet port in a first one of said pair of planar sides of said housing facing said inlet half of said crescent-shaped cavity, a primary discharge port in a second one of said pair of planar sides of said housing facing said discharge half of said crescent-shaped cavity and separated angularly from said inlet port by a timing angle $\theta_1$ which exceeds zero degrees, and a secondary discharge port in said first one of said pair of planar sides of said housing facing said discharge half of said crescent-shaped cavity and separated angularly from said inlet port by a timing angle $\theta_2$ which exceeds zero degrees and is less than said timing angle $\theta_1$ in which timing angle $\theta_2$ succeeding ones of said pump chambers are separated from each of said inlet port and said secondary discharge port, said secondary discharge port defining a restricted flow path from succeeding ones of said pump chambers to said primary discharge port when said pump chambers overlap said secondary discharge port in an angular interval $(\theta_1-\theta_2)$.

2. The gerotor pump recited in claim 1 wherein:

said secondary discharge port is defined by a groove on the order of 0.2 mm deep in said first one of said pair of planar sides of said housing.

3. An electric fuel pump for a motor vehicle comprising:

a tubular shell, an electric motor in said tubular shell having an armature shaft rotatable about a first centerline of said electric fuel pump, and a gerotor pump in said tubular shell including an outer ring gear rotatable on a housing of said gerotor pump about a second centerline of said electric fuel pump parallel to said first centerline and separated therefrom, an inner pinion gear inside of said ring gear connected to said armature shaft of said electric motor and rotatable by said armature shaft about said first centerline of said electric fuel pump with a crescent-shaped cavity defined between said ring gear and said pinion gear, a pair of planar sides of said housing closing opposite sides of said crescent-shaped cavity, a plurality of gear teeth on said ring gear and on said pinion gear cooperating in dividing said crescent-shaped cavity into an inlet half and a discharge half and into a plurality of pump chambers traversing said crescent-shaped cavity from said inlet half to said discharge half, an inlet port in a first one of said pair of planar sides of said housing facing said inlet half of said crescent-shaped cavity and connected to a source of motor vehicle fuel, a primary discharge port in a second one of said pair of planar sides of said housing facing said discharge half of said crescent-shaped cavity and separated angularly from said inlet port by a timing angle $\theta_1$ which exceeds zero degrees and connected to a discharge fitting of said electric fuel pump, and a secondary discharge port in said first one of said pair of planar sides of said housing facing said discharge half of said crescent-shaped cavity and separated angularly from said inlet port by a timing angle $\theta_2$ which exceeds zero degrees and is less than said timing angle $\theta_1$ in which timing angle $\theta_2$ succeeding ones of said pump chambers are separated from each of said inlet port and said secondary discharge port, said secondary discharge port defining a restricted flow path from succeeding ones of said pump chambers to said primary discharge port when said pump chambers overlap said secondary discharge port in an angular interval $(\theta_1-\theta_2)$.

4. The motor vehicle fuel pump recited in claim 3 wherein: said secondary discharge port is defined by a groove on the order of 0.2 mm deep in said first one of said pair of planar sides of said housing.

5. The motor vehicle fuel pump recited in claim 4 further comprising:

a low pressure pump in said tubular shell interposed between said inlet port of said gerotor pump and said source of motor vehicle fuel.

6. The motor vehicle fuel pump recited in claim 5 wherein said low pressure pump in said tubular shell interposed between said inlet port of said gerotor pump and said source of motor vehicle fuel comprises:

a regenerative turbine pump.

7. A positive displacement fluid pump, comprising:

an outer ring gear rotatable on a housing of the pump about a first centerline, an inner pinion gear inside of said ring gear rotatable on said housing of the pump about a second centerline parallel to and separated from said first centerline so that a crescent-shaped cavity is defined between said ring gear and said pinion gear, a pair of planar sides of said housing closing opposite sides of said crescent-shaped cavity, a plurality of gear teeth on said ring gear and on said pinion gear cooperating in dividing said crescent-shaped cavity into an inlet half and a discharge half and into a plurality of pump chambers traversing said crescent-shaped cavity from said inlet half to said discharge half, an inlet port in a first one of said pair of planar sides of said housing facing said inlet half of said crescent-shaped cavity, a primary discharge port in a second one of said pair of planar sides of said housing facing said discharge half of said crescent-shaped cavity and separated angularly from said inlet port for pumping low bulk modulus fluid, and a secondary discharge port in said first one of said pair of planar sides of said housing facing said discharge half of said crescent-shaped cavity and separated angularly from said inlet port for pumping high bulk modulus fluid, thereby defining a restricted flow path from succeeding ones of said pump chambers to said primary discharge port when said pump chambers overlaps with said secondary discharge port.

* * * * *